US010633128B2

(12) United States Patent
Este et al.

(10) Patent No.: US 10,633,128 B2
(45) Date of Patent: Apr. 28, 2020

(54) METHOD AND INSTALLATION FOR PRODUCING A SUPPORT FOR A PRODUCT PACKAGED IN A UNITARY DOSE

(71) Applicant: SWISSLOG AG, Buchs/Aarau (CH)

(72) Inventors: Flavio Este, Selvazzano Dentro (IT); Lorenzo Spagna, Guastalla (IT); Maurizio Bertoni, Maranello (IT)

( * ) Notice: Subject to any disclaimer, the term of this patent is extended or adjusted under 35 U.S.C. 154(b) by 234 days.

(21) Appl. No.: 15/751,040

(22) PCT Filed: Sep. 28, 2016

(86) PCT No.: PCT/IB2016/055789
§ 371 (c)(1),
(2) Date: Feb. 7, 2018

(87) PCT Pub. No.: WO2017/056008
PCT Pub. Date: Apr. 6, 2017

(65) Prior Publication Data

US 2018/0229877 A1 Aug. 16, 2018

(30) Foreign Application Priority Data

Sep. 29, 2015 (IT) ..... 102015000056177

(51) Int. Cl.
*B65B 11/50* (2006.01)
*B65B 15/02* (2006.01)
(Continued)

(52) U.S. Cl.
CPC ..... *B65B 11/50* (2013.01); *A61J 1/03* (2013.01); *B65B 11/48* (2013.01); *B65B 15/02* (2013.01);
(Continued)

(58) Field of Classification Search
CPC ..... B65B 11/004; B65B 11/06; B65B 11/08; B65B 11/48; B65B 11/50; B65B 15/00;
(Continued)

(56) References Cited

U.S. PATENT DOCUMENTS 2,050,270 A * 8/1936 Burnham ..... B65D 75/28 206/475
2,201,653 A * 5/1940 McCreary ..... B65D 73/0085 206/45.2
(Continued)

FOREIGN PATENT DOCUMENTS

CA 2871026 A1 * 10/2013 ..... B65B 11/004
DE 1953281 A1 * 6/1970 ..... B65D 73/0085
(Continued)

OTHER PUBLICATIONS

International Search Report and Written Opinion issued in Application No. PCT/IB2016/055789, dated Feb. 15, 2017 (8 pages).

*Primary Examiner* — Stephen F. Gerrity
(74) *Attorney, Agent, or Firm* — Flynn Thiel, P.C.

(57) ABSTRACT

An installation for producing a support for a product in a unitary dose including a supply member of a material web, a cutting apparatus to obtain a support card having a main portion, in which there is formed a main opening, and a foldable flap, in which there is formed a secondary opening. The installation further includes movement members for receiving the packaging of a product in a unitary dose so that a portion projects from the main opening and a peripheral edge is supported on the main portion of the card. The installation also includes folding members for folding the flap so as to enclose a portion of the peripheral edge between the flap and the main portion of the card. The installation also includes a fixing apparatus for fixing the flap to the main portion of the card.

10 Claims, 6 Drawing Sheets

(51) Int. Cl.
*B65D 73/00* (2006.01)
*A61J 1/03* (2006.01)
*B65D 75/20* (2006.01)
*B65B 11/48* (2006.01)

(52) U.S. Cl.
CPC ..... *B65D 73/0085* (2013.01); *B65D 75/20* (2013.01)

(58) Field of Classification Search
CPC ..... B65B 15/02; B65D 73/0042; B65D 73/0085; B65D 75/20
USPC ..... 53/461, 462, 203, 207, 208, 389.3; 206/476, 485, 487
See application file for complete search history.

(56) References Cited

U.S. PATENT DOCUMENTS 2,866,544 A * 12/1958 Klein et al. ..... B65D 73/0085 206/489
3,179,246 A * 4/1965 Rosenburg, Jr. ... B65D 73/0085 206/489
3,195,284 A * 7/1965 Crane, Jr. ..... B65B 11/52 53/453
3,248,842 A 5/1966 Peppler
3,418,785 A * 12/1968 Duryee ..... B65B 11/50 53/557
3,946,537 A 3/1976 Hair et al.
4,880,117 A * 11/1989 Garganese ..... B65D 73/0085 206/487
5,020,660 A * 6/1991 Akerley et al. .... B65D 73/0085 206/396
5,054,271 A * 10/1991 DeWoskin ..... B65B 11/50 53/559
5,109,984 A 5/1992 Romick
5,261,535 A * 11/1993 Light et al. ..... B65D 73/0042 206/391
5,272,853 A * 12/1993 Francioni et al. ..... B65H 19/10 53/389.3
5,404,693 A * 4/1995 Giovannone ..... B65B 11/48 53/453
6,006,911 A * 12/1999 Levy ..... B65D 73/0085 206/456
6,315,206 B1 * 11/2001 Hansen et al. ..... B65D 73/0085 235/380
7,726,486 B2 * 6/2010 Jones ..... B65D 73/0085 206/562
9,308,661 B2 4/2016 Este et al.
2005/0235475 A1 * 10/2005 Meyers ..... B65B 15/02 29/432
2006/0042987 A1 * 3/2006 Buss ..... B65D 83/0463 206/532
2010/0243507 A1 9/2010 Gelardi et al.
2010/0314044 A1 * 12/2010 Morris ..... B01D 46/0001 156/290
2012/0279098 A1 * 11/2012 Berenson et al. . B65D 73/0042 40/124.04
2013/0248406 A1 * 9/2013 Glinert ..... B65D 73/0085 206/497
2016/0083127 A1 * 3/2016 Tillstrom ..... B65B 11/50 53/410

FOREIGN PATENT DOCUMENTS

DE 9401867 U1 * 4/1994 ..... B65D 73/0085
DE 19854049 A1 * 5/2000 ..... B65D 73/0085
EP 1346929 A1 9/2003
EP 1346931 A1 9/2003
EP 1560756 A1 8/2005
EP 2603435 A1 6/2013
FR 1439126 A * 5/1966 ..... B65D 75/20
FR 1478068 A * 4/1967 ..... B65B 11/48
FR 2087814 A5 * 12/1971 ..... B65D 73/0085
GB 1271939 A * 4/1972 ..... B65B 11/48
WO WO 2004/033306 A1 4/2004
WO WO 2014/207507 A1 12/2014

* cited by examiner

METHOD AND INSTALLATION FOR PRODUCING A SUPPORT FOR A PRODUCT PACKAGED IN A UNITARY DOSE

The present invention relates to the sector of automated control of products packaged in unitary doses. The invention has been developed with particular regard, though not exclusively, for pharmaceutical products and the like, which are distributed by pharmacies in unitary doses for administration to patients in accordance with medical prescriptions.

Pharmaceuticals and similar products are administered in unitary doses in accordance with medical prescriptions which define in a precise manner the quantities and frequencies of administration. Those products are packaged in sealed packagings, which are opened only at the time of administration. For pharmaceuticals such as pills, tablets, capsules and the like, blister packs are very widespread, in which each dose of pharmaceutical is individually enclosed in a bubble of flexible material which is often transparent and which is closed by a film of flexible material, such as card or, more often, aluminum. Other pharmaceutical products, such as, for example, suppositories, or many products in powder or liquid form, are enclosed in sealed cases which are formed by two films of material which are brought together and joined along a common peripheral edge. The single doses of pharmaceuticals in blister packs are removed by pressing on the pharmaceutical acting on the bubble which contains it so as to break the film of flexible material. The cases are instead opened by tearing a flap thereof, at times in the region of a precise position of the peripheral edge at which a perforation has been formed beforehand.

Blister packs which are normally provided by the pharmaceutical companies comprise different doses of pharmaceutical products on a common substrate, each one enclosed in a respective bubble. For optimum control thereof, particularly in hospital pharmacies, those blister packs are cut and separated individually, in order to produce blister packs of unitary doses, for example, by means of one of the systems described in EP1560756 or EP2603435 of the same Applicant.

Packagings in unitary doses are very convenient for the automation of the prescriptions in the hospital sector and constitute a substantial improvement of ensuring that the patients take the correct pharmaceuticals, in the quantities and forms prescribed. However, as a result of the small dimensions thereof and the substantial quantities of products in unitary doses to be controlled, the automated control systems have to provide for particular arrangements for ensuring storage and movement which are easy, simple, verified and secure.

There are known various systems for storing and dispensing products in unitary doses, which are used in a particularly expedient and advantageous manner in the hospital sector. One of those systems, which has been developed by the present Applicant and is described in EP1346929, comprises a store which is produced so as to automatically control the quantities of pharmaceuticals stored, requests for supply and expiry dates of each pharmaceutical stored.

In the system of the prior art described in EP1346929, the pharmaceuticals are packaged in unitary doses, and each pack is placed inside a packet on which there are printed indications relating to the specific pharmaceutical, such as, for example, the commercial name thereof, the active ingredient, the production batch, the expiry date, in the form of both text and bar code. The packets containing the pharmaceuticals in unitary doses are suspended on hooks of the store in a state ready for being removed following a prescription by the hospital medical staff. For the distribution to the various hospital departments, the packets containing the pharmaceuticals in unitary doses for the same medical prescription are joined to each other by means of a ring-like fastening, as described in EP1346931 of the same Applicant. Each ring is composed of the prescribed pharmaceuticals in chronological order of administration, and is provided with a label which contains all the data of the patient for which it is intended.

The known system discussed in brief above has solved substantial problems in the control of the pharmaceutical in unitary doses in the field of hospital structures, where it is effective and appreciated. However, the present Applicant has considered further development of the system for controlling pharmaceuticals in unitary doses in order to improve the characteristics thereof and to make it even more advantageous, in particular in terms of greater efficiency and reliability and being less expensive, with regard to both the installation thereof and the ordinary control operations.

In fact, the Applicant has noted in the years of past experience in developing and providing the system described above that the packaging of the pharmaceuticals in unitary doses in packets to be suspended on hooks has some difficulties as a result of the need for handling an object which is substantially limp, which is initially obtained from a web or the like, by means of joining operations, and which then has to be kept open at an end thereof for the introduction of the unitary dose of pharmaceutical, in order then to be closed, sealed and subsequently handled during all the storage, removal, grouping and delivery steps of the pharmaceuticals in unitary doses to the hospital departments. Indicating on the packet the information relating to the specific pharmaceutical is also an operation which cannot be readily carried out.

In order to overcome the difficulties set out above and to improve the system for controlling the pharmaceutical in a unitary dose, the present Applicant has developed a support for pharmaceuticals in unitary doses which is described in WO 2014/207507 and which comprises a relatively rigid support card with a hole or a slot, in the region of which there is arranged the bubble of a blister of a pharmaceutical in a unitary dose. The edge of the blister of the pharmaceutical in a unitary dose is adhesively bonded directly to the support card or is fixed thereto by means of an adhesive film.

An object of the present invention is to provide an automatic installation for producing an improved support for a pharmaceutical in a unitary dose which is simple and economic. Another object of the invention is to provide an installation for producing a support for a pharmaceutical in a unitary dose which can receive both blister packs of different formats and packagings of different types, for example, mono-dose packets for pharmaceuticals in powder or liquid form, metallized bags for suppositories and the like, and so on.

In order to achieve the objects indicated above, the invention relates to an installation for producing a support for a packaged product in a unitary dose as defined in the appended claims.

According to a first aspect, there is described an installation for producing a support for a product in a unitary dose, comprising at least one supply member of at least one material web. The installation also comprises a cutting apparatus which can be controlled in order to obtain from the at least one material web a support card. The support card has a main portion, in which there is formed a main opening, and a foldable flap on the main portion, in which there is formed an opening or a notch or a pre-cut which is centred in a symmetrically equidistant manner from the centre of the main opening with respect to a folding line of the flap on the main portion. The installation further comprises movement members for receiving the packaging of a product in a unitary dose in the main opening in the main portion of the card so that a portion thereof projects from the main opening and a peripheral edge thereof is supported on the main portion of the card. The installation also comprises folding members for folding the flap along the folding line until it is brought to the main portion so as to enclose at least a portion of the peripheral edge between the flap and the main portion of the card. The installation also comprises a fixing apparatus for fixing the flap to the main portion of the card.

An opening at the flap may also serve to receive packagings which are more bulky than a blister pack in relative terms, such as, for example, a packet for suppositories or the like. The production of a single card of preferably flexible material which is folded in two portions in order to enclose a pack of product in a unitary dose constitutes a substantial simplification and a saving of costs with respect to the use of packets as in the prior art. Furthermore, the solution described allows connection of the product packaging in a unitary dose to the support without it being necessary to fix it directly thereto. This becomes evident in a greater simplicity for handling the small packagings in a unitary dose. Furthermore, there is no risk of affecting the products in a unitary dose by moving them too close to the packaging with the joining or bonding systems of the prior art.

Preferably, the installation comprises a rotary table which is provided to present in sequence the support cards from the cutting apparatus to operating stations which are arranged around the rotary table.

Preferably, the operating stations around the rotary table comprise a card deposit station, an indication fitting station, a connection station comprising the movement members, a folding station comprising the folding members, a joining station comprising the fixing apparatus and a card removal station.

Preferably, the cutting apparatus can be controlled in order to form in the flap of the support card an opening which is identical to the main opening. This allows provision of an opening for the removal of the product which substantially corresponds to the extent of the mouth of the bubble of a blister pack which is received in the main opening. The removal of the product from the blister pack is thereby easier.

According to a variant, the cutting apparatus can be controlled in order to extend the main opening at the flap so as to form the same slot. This allows the production of a support which is particularly advantageous for packets or packagings which open by pulling them at the edge. In fact, there is obtained with the provision of a single slot, with the flap folded, a support which exposes at the folded side a portion of the edge of the packet which is convenient to open.

Preferably, the flap is fixed to the main portion at least at three sides. The fourth side, corresponding to the fold side of the flap at the main portion of the support card, may not be fixed. The assembly operations of the support are thereby simplified. In any case, at least three fixing sides ensure that the product in a unitary packaging does not become separated though not fixed directly to the support card.

Preferably, the flap is fixed to the main portion by means of joining without any material being supplied. The operation is simple, secure and allows the integrity of the pharmaceutical inside the packaging in a unitary dose to be preserved.

According to a particular aspect, there is formed on the support card another opening or hole for suspending the support, for example, in a store provided with hooks.

According to a variant, the installation comprises one or more supply members for supplying at least two material webs of different widths so as to obtain respective cards having different dimensions which are capable of receiving and supporting products in unitary doses even with very different dimensions from each other.

According to another aspect, there is described a method for producing a support for a product in a unitary dose by means of an installation comprising the steps of:

controlling the at least one supply member for supplying at least one material web to the cutting apparatus;

controlling the cutting apparatus in order to obtain from the at least one material web a support card with a main portion, in which there is formed a main opening and a flap which can be folded on the main portion in which there is formed an opening or a notch or a pre-cut which is centred so as to be symmetrically equidistant from the centre of the main opening with respect to a folding line of the flap on the main portion;

controlling the movement members in order to receive the packaging of a product in a unitary dose in the main opening in the main portion of the card so that a portion thereof is discharged from the main opening and a peripheral edge thereof is supported on the main portion of the card;

controlling the folding members in order to fold the flap along the folding line until it is brought to the main portion so as to enclose at least a portion of the peripheral edge between the flap and the main portion of the card; and controlling the fixing apparatus in order to fix the flap to the main portion of the card.

Preferably, the flap is fixed to the main portion by means of joining without material being supplied.

Preferably, the support card is obtained by being cut or sliced from a material web.

Preferably, one or more supply members supply at least two material webs having different widths in order to obtain respective cards having different dimensions.

Additional characteristics and advantages will be appreciated from the following detailed description of some preferred embodiments which is given purely by way of non-limiting example with reference to the appended drawings, in which.

Figure 7A:
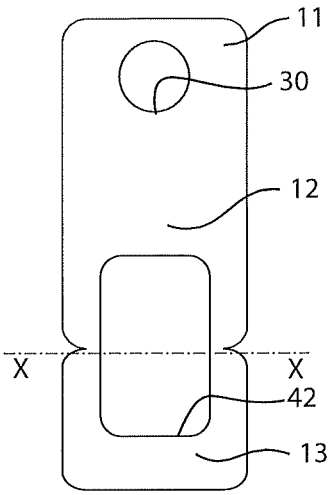
Figure 14:
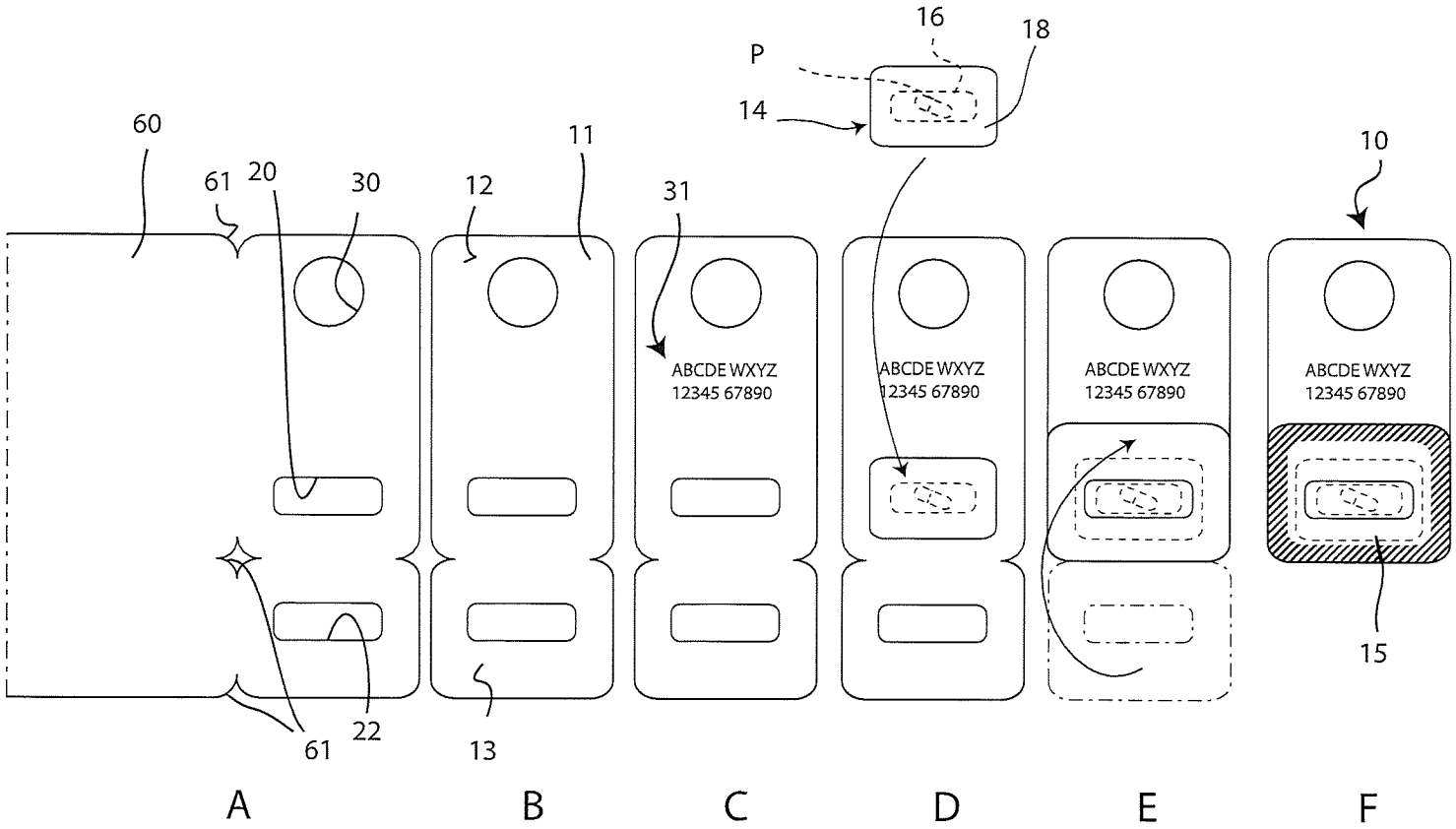
Figure 15:
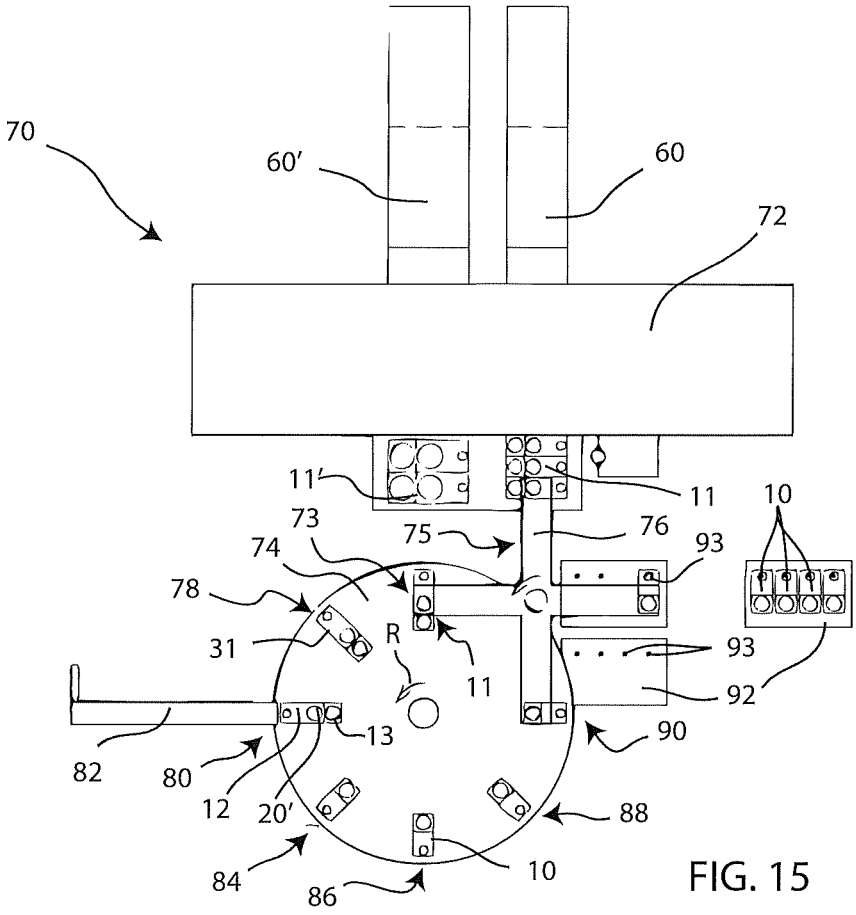
Figure 16:
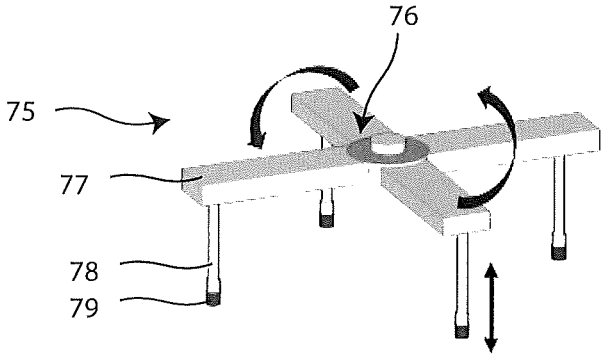

FIGS. 7A; 7B to 13A; 13B schematically illustrate other variants of the support for a unitary dose according to the present invention in configurations preceding and following the assembly thereof, respectively;

FIG. 14 is a schematic view of the production and assembly steps of a support for products in a unitary dose according to the invention;

FIG. 15 is a schematic top view of an embodiment of the automatic installation for producing supports for products which are packaged in unitary doses according to the principles of the present invention; and FIG. 16 is a schematic perspective view of an embodiment of a removal tool which is used in the installation of the present invention.

The term "card" is used in the present description in order to identify the support structure to which the product packaged in a unitary dose is connected. However, the term "card" does not have to be understood in restrictive terms which limit the formation or the material or another characteristic thereof. The term "card" is instead intended to be understood to be an artificial expression because the support structure has a relatively small thickness with respect to the other two dimensions and the combination of that small thickness and the material used for producing the support structure, that is to say, the "card", make it possible—optionally with the assistance of a weakening zone of the material—to fold a portion thereof onto another, as will be better described below.

Figure 1:
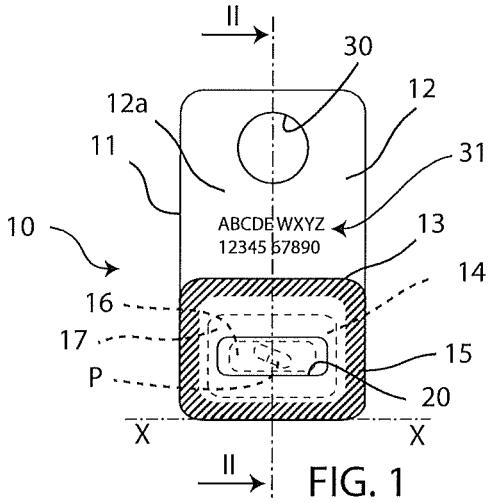
FIG. 1 is a front view of a first embodiment of a support for a product in a unitary dose which can be produced with the installation according to the invention, in an assembled configuration.
Figure 2:
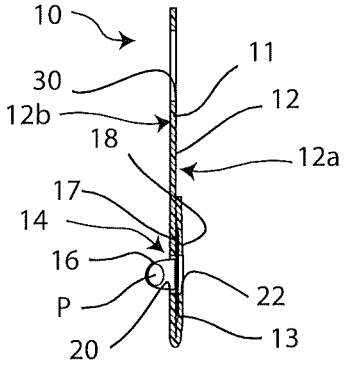
FIG. 2 is a cross-section along the line II-II of FIG. 1.
Figure 3:
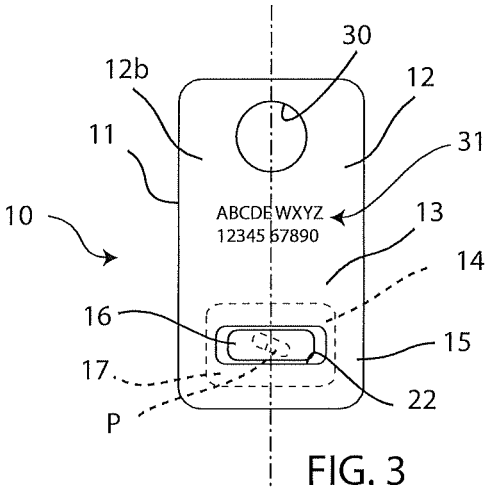
FIG. 3 is a rear view of the embodiment of a support of FIG. 1, in accordance with the arrow III of FIG. 2.

With reference now to FIGS. 1 to 3, a support 10 for a product in a unitary dose comprises a card 11, for example, a sheet of cardboard or plasticized card, a sheet of plastics material, a thin metal sheet or the like, with a main portion 12 and a flap 13 which is folded along a folding line X-X, corresponding to an edge of the support 10 in the assembled configuration shown in the Figures. The flap 13 only partially overlaps with the main portion 12 and is fixed thereto along a portion or all of a peripheral edge zone 15, which is conventionally indicated with broken lines in FIG. 1. In accordance with the material of the card 11 and/or the production technology used, the fixing may be carried out by welding or adhesive bonding or with mechanical fixing by means of clips or the like. Preferably but in a non-limiting manner, the material of the card 11 is a plastics material and the joining of the flap 13 to the main portion 12 is carried out by ultrasonic welding. The ultrasonic welding prevents generalized heating of the material and therefore does not affect the characteristics of the product in a unitary dose, which is particularly advantageous in the case of a pharmaceutical. Ultrasonic welding is further convenient with respect to the adhesive bonding because it does not supply additional material. In some cases, in accordance with the rigidity of the material of the card 11 and the particular fold carried out in order to bring the flap 13 onto the main portion 12, it is not necessary to fix the edge along the folding line X.

It is possible to form a hole 30 in the main portion 12 of the card 11, which is advantageous for suspending the support 10 for a product for unitary doses, for example, in the hook type store described in EP1346929 by the same Applicant.

In the main portion 12 of the card 11, for example, in the zone of the face 12*a* thereof left free by the flap 13 and/or on the other face 12*b* opposite the face to which the flap 13 is fixed, it is possible to fit indications 31 for identifying the product in a unitary dose. The indications 31 may be fitted by writing directly on the main portion 12, for example, by means of printing or engraving, or other known means, or by fixing to the main portion 12 a label or other pre-printed element. The indications 31 may also be stored on an RFID tag or other similar elements intended to be fixed to the main portion 12 of the card 11. The indications 31 may be depicted in any known manner, both in a clear state and by means of a bar code, a QR code or the like.

There is retained between the main portion 12 and the flap 13 of the card 11 a blister pack 14 of a product in a unitary dose. As will be better appreciated below, the invention is not limited to the support of products in a unitary dose contained in blister packs, but can instead advantageously also be adapted to use with products in a unitary dose in different packagings, such as, for example, envelopes or packets, of the type generally in use in the sector of the products in a unitary dose of the pharmaceutical type.

The blister pack 14 comprises a bubble 16 in which there is received a product P in a unitary dose, for example, a pill or a tablet of a pharmaceutical. The bubble 16, which is generally of plastics material, comprises a peripheral edge 17 and is closed by a film 18, which is usually of metal or paper, which is joined to the peripheral edge 17. As known, by pressing on the bubble 16 it is possible to extract where necessary the product P in a unitary dose from the blister pack 14 by breaking the film 18.

There is formed in the main portion 12 of the card 11 a main opening 20, in which there is inserted the bubble 16 of the blister pack 14. The dimensions of the main opening 20 are such that the bubble 16 may project from the main portion 12 of the card 11, at the side opposite the flap 13, while the peripheral edge 17 of the blister pack 14 is at least partially wider than the main opening 20 so that it remains arranged between the main portion 12 and the flap 13 superimposed thereon and fixed thereto.

There is formed in the flap 13 a secondary opening 22 which is substantially centred with respect to the main opening 20. It is possible to extract the product P through the secondary opening 22 when the bubble 16 of the blister pack 14 is compressed during use.

The main opening 20 shown in the non-limiting example of FIGS. 1 to 3 is substantially of rectangular form with smoothed corners, or generally slot-like elongate form. The long side of the main opening is arranged transversely with respect to the width of the card 11. The secondary opening 22 of this example has the same dimensions as the main opening 20 and entirely overlap it. The main opening 20 of slot-like elongate form may readily receive the bubble 16 of a blister pack 14 having a corresponding form, of the type, for example, used to package pills of elongate form, such as the pill P shown in the example of FIGS. 1 to 3. The corresponding form of the secondary opening 22 then allows the easy extraction of the pill P from the bubble 16 without the user being aware of any significant difference with respect to the removal of a pill from a blister pack of the common type. In fact, the film 18 which closes the bubble 16 may readily break following the pressure applied to the pill P during the compression of the bubble 16, and the pill P may readily be discharged from the blister pack 14 because the secondary opening 22 has an extent which substantially corresponds to the extent of the mouth of the bubble 16. Furthermore, the thickness of the card 11 is rather thin and therefore does not constitute an impediment to extraction of the pill P.

The card 11 is preferably produced from a material which is flexible but for all that not too soft or flexible. It is thereby possible to produce a reaction on the card 11 to extract the product in a unitary dose from the blister pack so as to compensate for the difficulty of using only the peripheral edge 17, which is usually of small dimensions. From that aspect, the present invention solves a problem of the prior art in which the products in a unitary dose are inserted in packets, which are only used for storing the products.

When the secondary opening 22, as in the example of FIGS. 1 to 3, has great dimensions and substantially corresponds to the dimensions of the mouth of the bubble 16 of the blister pack 14, it is possible to read through it at least a portion of the information usually printed on the film 18 which closes the bubble 16. In this manner, it is possible to carry out a control of the product in a unitary dose associated with the support 10. Even more preferably, the material of the card 11 is transparent in such a manner that, through the flap 13, independently of the dimensions of the secondary opening 22, it is possible to read the information printed on the film 18 of the blister pack 14.

The slot-like elongate form of the main opening 20, or rectangular form with smoothed corners, or more generally oblong, illustrated in FIGS. 1 to 3, can advantageously also be used in association with blister packs different from oblong ones. In other words, the dimensions and the form of the main opening 20 are not necessarily connected with the form of the bubble of the blister pack in a unitary dose, even if—as will be shown below—it is possible and advantageous also to produce on an industrial scale a production line in which the main opening 20 and/or the secondary opening 22 are different from product to product.

Figure 4:
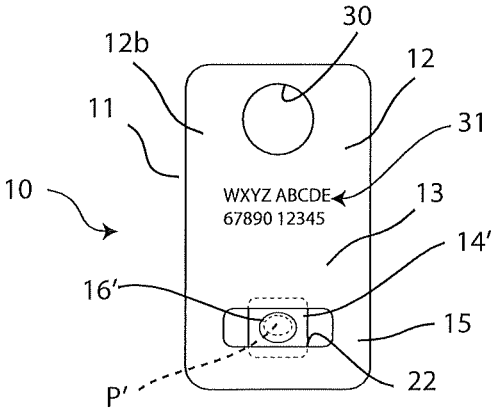
FIG. 4 is a rear view of the embodiment of a support of the preceding Figures, in a state assembled with a different product in a unitary dose having a blister pack different from the one in FIGS. 1 to 3.

As illustrated in FIG. 4, the same support 10 for a product in a unitary dose may be used for a product P', for example, a pill, contained in a blister pack 14' having a bubble 16' which is substantially in the form of a spherical cap. In this case, the bubble 16' of the blister pack 14', though projecting from the main opening 20, does not take up the whole of the extent and, in accordance with the rigidity of the material of the card 11 and the fixing, which is more or less loose, of the flap 13 to the main portion 12, could optionally be moved with greater or lesser ease along the main opening 20, but without being discharged therefrom.

Figure 5:
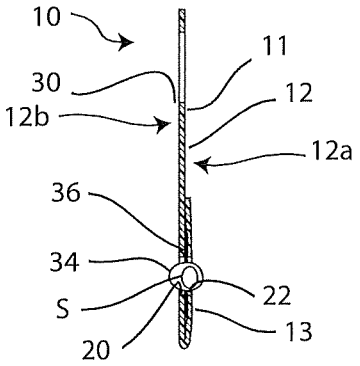
FIG. 5 is a cross-section similar to the one in FIG. 2 which shows the support of the preceding Figures in a state assembled with a product in a unitary dose contained in a different packaging.

The provision of a wide secondary opening 22 is advantageous if, as illustrated in FIG. 5, a product in a unitary dose P" is not received in a blister pack but instead in a packet 34 which does not have a planar side, but is instead provided with an end edge 36 which can be retained between the main portion 12 of the card 11 and the flap 13. The packet 34, which in a typical exemplary but non-limiting case may contain a suppository S or other product in a unitary dose, may project from both sides of the support 10.

Figure 6:
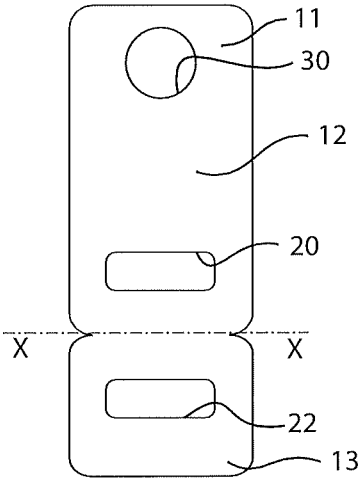
FIG. 6 is a view of a card of a material which is provided for producing the support for a product in a unitary dose of FIGS. 1 to 5.

As can be seen in FIG. 6, the support 10 for a product in a unitary dose described above is advantageously produced from a card 11 of material with a degree of flexibility, but not too flexible or soft. Preferably, the card 11 is a thin sheet of plastics material, but as set out above there may also be used for the purpose different materials such as a sheet of paper or plasticized cardboard, a thin metal sheet, or the like. In the non-assembled condition of the support 10, the card 11 is in a state with the flap 13 extending in the same plane as the main portion 12. The main opening 20 and the secondary opening 22 which in this non-limiting example have identical forms and dimensions but which—as will be seen below may also be different therefrom—are formed in a symmetrical position with respect to the transverse folding line X-X. The transverse folding line X-X may simply be a geometric line, or may be marked on the card 11 by a proper incision or engraving or weakening line in the material of the card 11 for easier folding thereof, especially in the case of material which is not too thin or is quite inflexible.

Figure 7B:
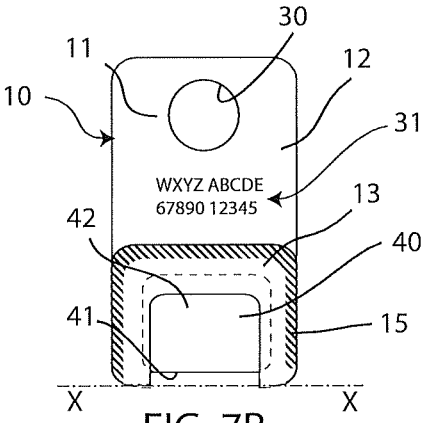

FIGS. 7A and 7B show a variant of the support 10 for a product in a unitary dose in the configuration of the card 11 before assembly and in the assembled configuration of the support 10, respectively. This variant of the support 10 is particularly suitable for a pharmaceutical or other product which is packaged in a packet 40, such as, for example, an orally soluble product, a soluble powder, or a sterile gauze, etc. In order to open a packaging of this type, it is normally necessary to tear an end edge thereof. The support 10 may therefore be produced so as to have a single opening or slot 42 which is produced over half of the extent in the main portion 12 and over the other half of the extent in the flap 13 of the card 11. When the flap 13 is folded and fixed to the main portion 12, the edge of the support 10 corresponding to the folding line X-X is interrupted by the opening 42, leaving exposed a side 41 of the packet 40 while the other sides of the packet are gripped between the flap 13 and the main portion of the card 11. In this case, it is advantageous for the joining 15 between the flap 13 and the main portion 12 to be carried out at only three sides, excluding the edge of the support 10 corresponding to the folding line X-X.

Figure 8A:
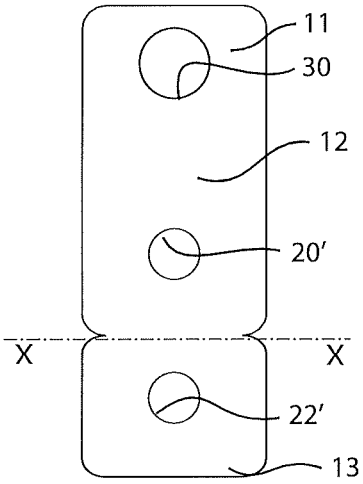
Figure 8B:
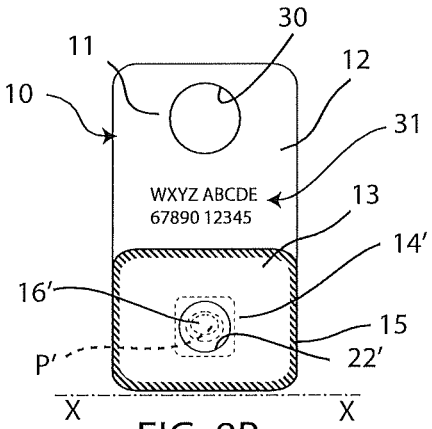

FIGS. 8A and 8B show a variant of the support 10 for a product in a unitary dose in the configuration of the card 11 before assembly and in the assembled configuration of the support 10, respectively. This variant of the support 10 is particularly constructed for a product P', for example, a pill, which is contained in a blister pack 14' having a bubble 16' which is substantially in the form of a spherical cap. In this case, unlike the variant of FIG. 4, the bubble 16' of the blister pack 14' is surrounded by the edge of a circular main opening 20'. The secondary opening 22' is also circular with dimensions substantially corresponding to the main opening 20' so as to overlap it in the assembled configuration of the support 10, illustrated in FIG. 8B, with the flap 13 overlapping and fixed to the main portion 12 of the card 11. In this case, the joining 15 may be produced over all or some of the peripheral extent of the flap 13.

Figure 9A:
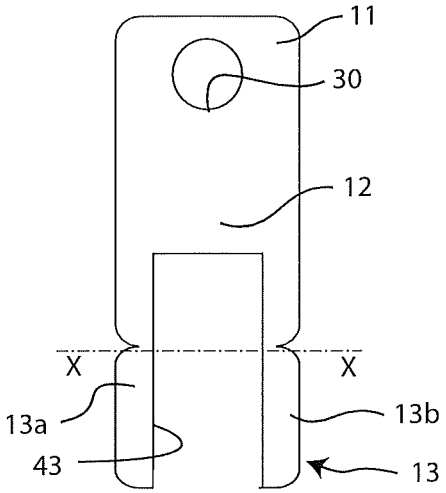
Figure 9B:
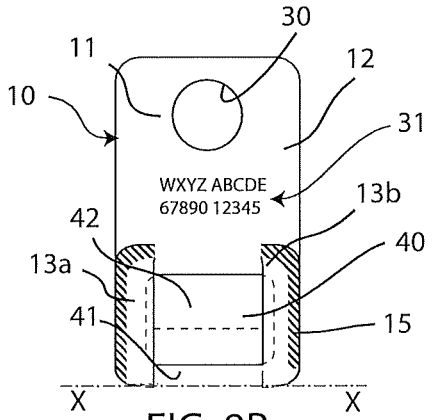

FIGS. 9A, 9B show a variant of the support 10 in which in the main portion 12 and the flap 13 of the card 11 there is produced a wide aperture 43 which extends as far as the end of the flap 13 which is reduced to two branches 13*a*, 13*b*. In the folded configuration illustrated in FIG. 9B, the two branches 13*a*, 13*b* are folded on the main portion 12 of the card 11, to which they are fixed, as described above, for example, by means of welding or adhesive bonding in the shaded zones 15 in the Figure. The support 10 has an access from the outer side to the pharmaceutical packaging retained therein, so as to allow—as in the example of FIG. 7A, 7B—the edge 41 thereof to be torn if it is a packet 42.

Figures 10A, 11A, 12A, 13A:
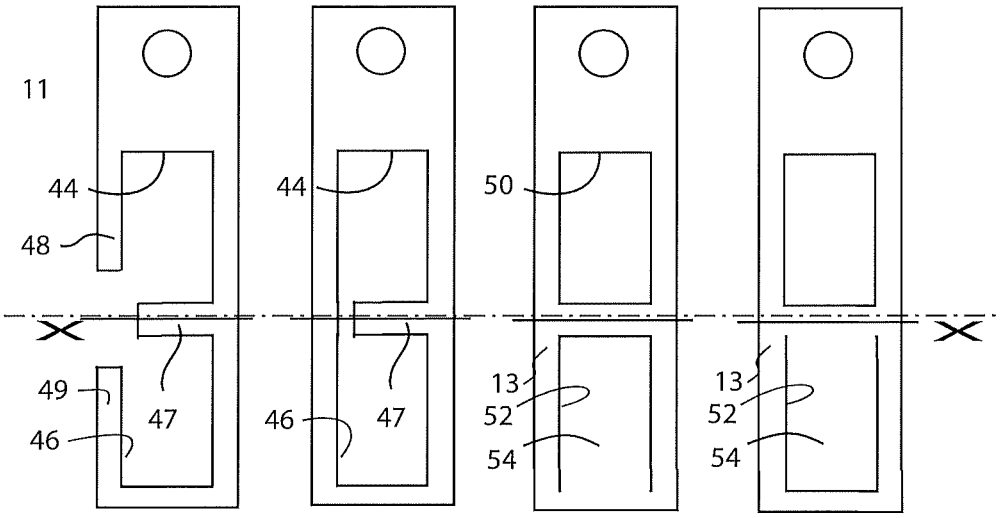

FIGS. 10A; 10B to 13A; 13B show other construction variants of the card 11, which is illustrated before and after the folding of the flap 13 onto the main portion 12, respectively. For ease of illustration, there has been omitted the depiction of the product packaging in a unitary dose which, in the folded configuration of the card 11, is retained between the flap 13 and the main portion 12 in order to form the support for a product in a unitary dose as in the present invention.

Figures 10B, 11B, 12B, 13B:
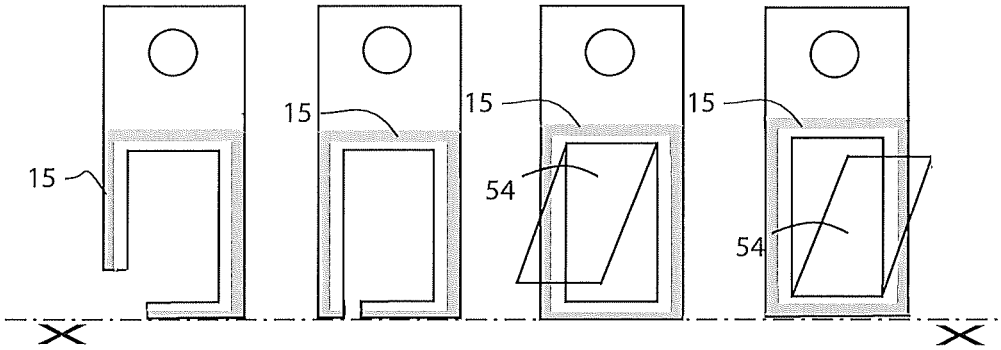

FIGS. 10A, 10B show a variant of the support 10 in which there are formed in the main portion 12 and the flap 13 of the card 11 two wide openings 44, 46, which are symmetrical with respect to the folding line X-X. There is further removed a lateral portion of the card 11 in the region of the folding line X-X so that the resultant card 11 has a branch 47 in the region of the folding line X-X and two symmetrically facing branches 48, 49 on the main portion 12 and on the flap 13. In the folded configuration illustrated in FIG. 10B, which shows as a shaded portion the possible joining 15, the support 10 has an access from the outer side to the pharmaceutical packaging which is retained in the support 10 so as to allow, as in the examples of FIGS. 7A, 7B and 9A, 9B, the edge thereof to be torn if it is a packet.

FIGS. 11A, 11B show a configuration of the card 11 similar to the configuration of FIGS. 10A, 10B but in which, in addition to the wide openings 44, 46, which are symmetrical with respect to the folding line X-X, there is removed only a small portion of the card 11 which connects the openings 44, 46, in the region of the folding line X-X, thereby producing the single branch 47 in the region of the folding line X-X. This variant leaves open, in the folded configuration of the card 11 as in FIG. 11B, a small portion at the folding edge, which is advantageous for accessing, as in the examples of FIGS. 7A, 7B; 9A, 9B and 10A, 10B, an edge of a packet which is enclosed between the flap 13 and the main portion 12.

FIGS. 12A, 12B show a variant of the support 10, in which there is produced in the main portion 12 an opening 50 which is capable of receiving, for example, the bubble of a blister pack of a product in a unitary dose, as already described above with reference to FIGS. 1 to 4. It should be noted that the opening 50 may be of a desired form and dimensions, for example, it may assume the oblong form of the opening 22 of FIGS. 1 to 4, or the circular form of FIGS. 8A, 8B. The dimensions of the opening 50 are also non-limiting, being able to vary in accordance with the dimensions of the bubble of the blister pack of the product in a unitary dose to be connected to the card 11. In this particular variant, there is not produced in the flap 13 a complete opening but instead a simple notch 52 which serves to form a tongue 54. In the folded configuration of the card 11, shown in FIG. 12B, the tongue 54 may be folded in order to allow the product in a unitary dose to be discharged when the bubble of the blister pack is compressed. In this variant, the film which closes the bubble of the blister pack is more protected than in the variants illustrated above, which provide for a true opening in the flap 13 of the card 11.

FIGS. 13A, 13B show a variant of the support 10 as in FIGS. 12A, 12B but in which the tongue 54' can bend in the opposite direction as a result of a notch 52' which is produced in a different manner.

Naturally, the notches 52, 52' which are illustrated in the preceding Figures by way of example can be produced on the flap 13 with different methods and geometries. For example, it would be possible to produce a cross-shaped notch which is substantially centred—in the folded configuration of the card 11—with the centre of the opening formed in the main portion. It would then be possible to produce partial notches or pre-cuts so as to break the material of the flap 13 in the region thereof only when the pressure is applied in order to cause the product in a unitary dose to be discharged from the blister pack which is connected to the card 11 in the support 10.

The production of the support for a product in a unitary dose according to the invention may readily be automated and produced by means of an industrial installation which supplies high levels of productivity and which is flexible in relation to the format of the products in a unitary dose being introduced.

FIG. 14 schematically shows the production steps of a support 10 for a unitary dose of the type described above.

In a first step A, a web 60 of the material from which the card 11 is intended to be produced is cut again in order to produce therein the desired openings. In the example of FIG. 14, there are produced in the web 60 the openings 20, 22 of the example of a support described above and the hole 30. There can also be produced other cuts and notches 61 in order to confer on the card 11 the final formation desired. Subsequently, in the step B the web 60 is cut transversely in order to obtain the single strips 11. Preferably, the strips 11 are produced in the transverse direction of the web 60 so that the flaps 13 are directed towards a side of the web 60 (at the bottom in FIG. 13) and thereby to be accessible to a folding tool without it being necessary to space apart or excessively space apart the strips 11 from each other. The indication 31 is then fitted to each card 11 which is obtained from the web 60. A blister pack 14 of a product P in a unitary dose is then connected to the card 11 by inserting the bubble 16 in the main opening 20 which is produced in the main portion of the card 11. It is preferable for the connection of the product in a unitary dose with respect to the card 11 to be brought about immediately after or immediately before the fitting of the indications to the card 11 in order to prevent errors. Subsequently, the flap 13 is folded on the main portion 12 of the card 11. The subsequent step provides for the joining or adhesive bonding along the zone 15 of the flap 13 on the main portion 12. The support 10 for a product P in a unitary dose is therefore complete and ready for the subsequent movement thereof.

FIG. 15 illustrates an example of an installation 70 for the automated production of supports for products packaged in unitary doses in accordance with the principles of the present invention. The installation comprises a supply member of the type generally known for a web of material 60 from which it is intended to obtain the support cards 11 described above. It may further also comprise one or more additional supply members of other webs, for example, the web 60' having a greater width than the web 60, from which it is intended to obtain support cards 11' having a format greater than the support cards 11.

The webs 60, 60' pass below and through a cutting apparatus 72, of the type which is also generally known, which provides for the production of the openings 20, 22, the hole 30 and the other cuts and notches 61 in order to confer on the card 11 or 11' the final formation desired, in accordance with what has been described with reference to the steps A and B of FIG. 14. The cutting apparatus 72 preferably also provides for the progressive separation of the cards 11, 11' from the respective webs 60, 60' while they advance in accordance with the requirements of the system. The cutting apparatus 72 may be of a very simple type, for example, of the punch type, in order to produce cards 11, 11' which are all identical to each other, or it may be more complex with multiple cutting options or actually programmable in real time in order to obtain a greater flexibility and to produce where necessary cards 11, 11' of a different type from each other, for example, in order to accommodate different packagings of products in a unitary dose which are supplied to the installation.

The various operations on each card 11, 11' are carried out by machines or apparatuses which are arranged around a rotary table 74, preferably in angular positions which are equidistant with respect to the circumference of the rotary table 74. A removal tool 75 is controlled in order to selectively remove the cards 11 or 11' downstream of the cutting apparatus 72 and to transport them in sequence on the rotary table 74, depositing them in a first card deposit station 73 while the rotary table 74 rotates. The Figure illustrates for the sake of simplicity operations which involve only cards 11 which have a first dimension and which are obtained from the material web 60 and positioned on the rotary table 74 but naturally the following description applies identically to the operations carried out on the cards 11' which have a greater format and which are obtained from the material web 60'. The sequence of cards 11, 11' which are positioned on the rotary table 74 in the card deposit station 73 is defined by a control system which is controlled by a programmed electronic processor which is not illustrated in the Figures.

FIG. 16 schematically illustrates an example of a removal tool 75 which is provided with a rotatable cross-member 76, the four arms 77 of which carry at the respective ends thereof retractable fittings 78, at the lower ends of which there are mounted respective engagement members 79, for example, of the suction type.

During the rotation thereof in the direction of the arrow R, the rotary table 74 first carries the card 11 at the front to an indication fitting station 78, in which there are fitted to the card 11 the indications 31 which are relevant or necessary for the identification of the product in a unitary dose to be associated with the card 11, as described above and in accordance with the step C of FIG. 14. The indication fitting station 78 may be equipped with a printer (not illustrated) which reproduces the indications 31 directly on the material of the card 11, as in the examples described above. However, it is also possible to provide the indication fitting station 78 with other means of the known type in order to position indications on the card 11. For example, there may be provided a printer for labels to be applied to the card 11.

During the subsequent rotation step, the rotary table 74 moves the card 11 at the front to a connection station 80, in which a packaged product in a unitary dose is connected to the card 11, as described in the preceding examples and also illustrated in the step D of FIG. 14. The packaged products in a unitary dose are successively supplied to the connection station 80 by means of a transport system 82 of the generally known type, for example, a transport belt, a gripper, a chute, a handling robot and other systems known in the sector of automation. If the packaged product in a unitary dose has a protuberance, such as, for example, the bubble of a blister pack in a unitary dose, or the swelling of a packet or bag containing a suppository, a bottle, gauze and the like, this protuberance is preferably inserted in the main opening (for example, one of the main openings 20, 20', 42, 43 described and illustrated above) provided on the main portion 12 of the card 11, so that a planar portion of the packaging is supported on the main portion 12 of the card 11. If the packaging of the product in a unitary dose is relatively flat, however, such as, for example, a packet of products in powder form or the like, it is sufficient for it to be supported on the card 11 so that a portion thereof faces away from the main opening while a peripheral edge thereof lies at least partially on the main portion of the card 11.

During the subsequent rotation step, the rotary table 74 moves the card 11 to a folding station 84, in which the flap 13 of the card 11 is folded on the main portion 12 of the card 11, for example, by means of a gripper (not illustrated in the Figures) or similar means. In this step, corresponding to step E of FIG. 14, at least a portion of the peripheral edge of the product packaging in a unitary dose is enclosed between the flap 13 and the main portion 12 of the card 11. The folding is produced about the folding line X-X and is provided so that the secondary opening or the notch or the pre-cut formed in the flap 13 are substantially centred with respect to the main opening in the main portion 12 of the card 11.

During the subsequent rotation step, the rotary table 74 moves the card 11 to a joining station 86, in which the contour of the flap 13 of the card 11 is joined, preferably with ultrasonic welding, to the main portion 12 by establishing the joining zone 15, as also illustrated in the step F of FIG. 14. At this point, the production of the support 10 for a product packaged in a unitary dose is finished.

During the subsequent rotation step, the rotary table 74 moves the finished support 10 to a station 88 where optional or special operations can be carried out, such as, for example, a quality control, an additional printing, reading of identification codes, X-ray control, weighing, verification of the integrity of the product in a unitary dose, etc.

During the subsequent rotation step, the rotary table 74 moves the finished support 10 to a removal station 90, where the support 10 is removed and conveyed to the subsequent destination thereof, for example, a store. In the example of FIG. 15, the support 10 is removed by the same removal tool 75 described above, and deposited in a support container 92, for example, but in a not-limiting manner, of the cartridge type with a plurality of hooks 93. The hole 30 which is produced in the card 11 is used for fitting the support 10 in the support container 92. Once the desired filling of supports 10 is achieved, the support container 92 is conveyed to a store, for example, the store of a centralized hospital pharmacy.

Naturally, the principle of the invention remaining the same, the forms of embodiment and details of construction may be varied widely with respect to those described and illustrated, without thereby departing from the scope of the present invention.

The invention claimed is:

1. An installation for producing a support for a product in a unitary dose, comprising at least one supply member of at least one material web, a cutting apparatus which can be controlled in order to obtain from the at least one material web a support card having a main portion, in which there is formed a main opening, and a foldable flap on the main portion, in which there is formed a secondary opening or a notch or a pre-cut which is centred in a symmetrically equidistant manner from the centre of the main opening with respect to a folding line of the flap on the main portion, movement members for receiving the packaging of a product in a unitary dose in the main opening in the main portion of the card so that a portion thereof projects from the main opening and a peripheral edge thereof is supported on the main portion of the card, folding members for folding the flap along the folding line until it is brought to the main portion so as to enclose at least a portion of the peripheral edge between the flap and the main portion of the card, and a fixing apparatus for fixing the flap to the main portion of the card.

2. An installation according to claim 1, comprising a rotary table which is provided to present in sequence the support cards from the cutting apparatus to operating stations which are arranged around the circumference of the rotary table.

3. An installation according to claim 2, wherein the operating stations comprise a card deposit station, an indication fitting station, a connection station comprising the movement members, a folding station comprising the folding members, a joining station comprising the fixing apparatus and a card removal station.

4. An installation according to claim 1, wherein the cutting apparatus can be controlled in order to form in the flap the secondary opening which is identical to the main opening.

5. An installation according to claim 1, wherein the cutting apparatus can be controlled in order to extend the main opening at the flap so as to form the same slot with the secondary opening.

6. An installation according to claim 1, wherein the flap is fixed to the main portion at least at three sides.

7. An installation according to claim 1, wherein the flap is fixed to the main portion by means of joining without any material being supplied.

8. An installation according to claim 1, comprising one or more supply members for supplying at least two material webs of different widths so as to obtain respective cards having different dimensions.

9. A method for producing a support for a product in a unitary dose by means of an installation according to claim 1, comprising the steps of:

controlling the at least one supply member for supplying at least one material web to the cutting apparatus;

controlling the cutting apparatus in order to obtain from the at least one material web a support card with a main portion in which there is formed a main opening and a flap which can be folded on the main portion in which there is formed a secondary opening or a notch or a pre-cut which is centred so as to be symmetrically equidistant from the centre of the main opening with respect to a folding line of the flap on the main portion;

controlling the movement members in order to receive the packaging of a product in a unitary dose in the main opening in the main portion of the card so that a portion thereof is discharged from the main opening and a peripheral edge thereof is supported on the main portion of the card;

controlling the folding members in order to fold the flap along the folding line until it is brought to the main portion so as to enclose at least a portion of the peripheral edge between the flap and the main portion of the card; and controlling the fixing apparatus in order to fix the flap to the main portion of the card.

10. A method according to claim 9, wherein one or more supply members supply at least two material webs having different widths in order to obtain respective cards having different dimensions.

* * * * *